US008011168B2

(12) United States Patent
Devaux

(10) Patent No.: US 8,011,168 B2
(45) Date of Patent: Sep. 6, 2011

(54) INSTALLATION FOR PACKING BOTTLE-TYPE OBJECTS OF DIFFERENT DESIGNS INTO BOXES

(75) Inventor: Eric Devaux, Octeville-sur-Mer (FR)

(73) Assignee: Sidel Participations, Octeville-sur-Mer (FR)

( * ) Notice: Subject to any disclaimer, the term of this patent is extended or adjusted under 35 U.S.C. 154(b) by 136 days.

(21) Appl. No.: 12/306,138

(22) PCT Filed: Jun. 20, 2007

(86) PCT No.: PCT/FR2007/001016

§ 371 (c)(1),
(2), (4) Date: Feb. 26, 2009

(87) PCT Pub. No.: WO2007/147969

PCT Pub. Date: Dec. 27, 2007

(65) Prior Publication Data

US 2009/0277130 A1 Nov. 12, 2009

(30) Foreign Application Priority Data

Jun. 21, 2006 (FR) ..... 06 05529

(51) Int. Cl.
*B65B 5/00* (2006.01)

(52) U.S. Cl. ..... 53/247; 53/236; 53/443

(58) Field of Classification Search ..... 53/247, 53/154, 540, 147, 543, 236, 242, 443, 444, 53/473; 414/425, 778, 766
See application file for complete search history.

(56) References Cited

U.S. PATENT DOCUMENTS

| | | | | |
|---|---|---|---|---|
| 2,308,209 | A * | 1/1943 | Schmutzer et al. | 294/119.3 |
| 4,053,251 | A * | 10/1977 | Shichida et al. | 408/35 |
| 4,355,446 | A * | 10/1982 | Shimajiri et al. | 29/26 A |
| 4,486,045 | A * | 12/1984 | Trygg | 294/87.1 |
| 4,486,928 | A * | 12/1984 | Tucker et al. | 29/26 A |
| 4,655,676 | A * | 4/1987 | Jannborg et al. | 414/736 |
| 4,778,329 | A * | 10/1988 | Phillips | 414/589 |
| 5,018,776 | A * | 5/1991 | Trygg | 294/119.3 |
| 5,735,782 | A * | 4/1998 | Berg | 483/1 |

FOREIGN PATENT DOCUMENTS

| | | |
|---|---|---|
| DE | 25 34 183 A1 | 2/1977 |
| FR | 2 876 615 A1 | 4/2006 |
| WO | 96/09145 A1 | 3/1996 |

* cited by examiner

*Primary Examiner* — Sameh H. Tawfik
(74) *Attorney, Agent, or Firm* — Sughrue Mion, PLLC

(57) ABSTRACT

A packing installation having a handling head (10) with replaceable tulip-like gripping tools (11) connected by couplers (13). The installation has a magazine (15) with separate groups of tools (11) and a several presentation units (23) for the tools. The presentation units (23) have a spindle (25) to accommodate the tools (11). The spindle (25) is a floating type to give some flexibility and to engage the tools (11) not only during the depositing operation, but also during the gripping operation. The magazine (15) is mobile and is mounted on tracks (19) to move between its inactive position, away from the field of action of the bottle handling head (10), and its active position within the field of action of the head (10) and in particular at the station (5) where the bottles are picked up by the head (10).

11 Claims, 5 Drawing Sheets

Fig. 16
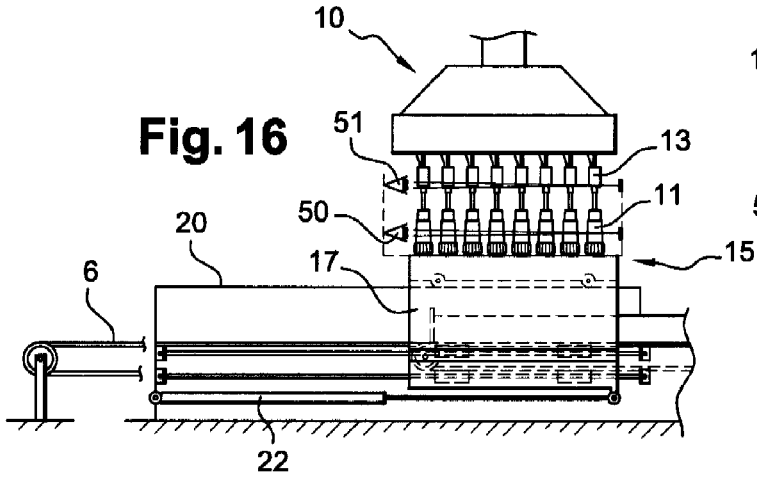
Fig. 17
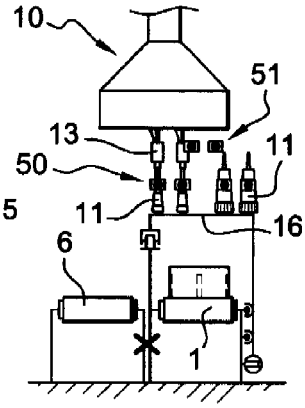
Fig. 18
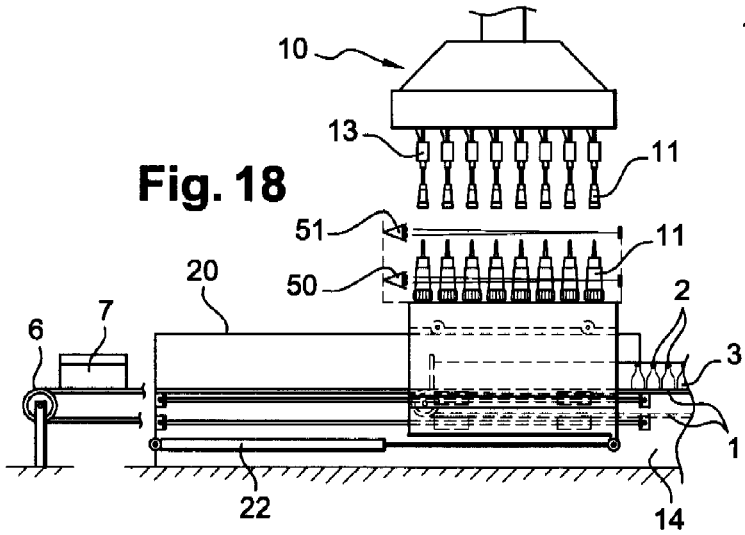
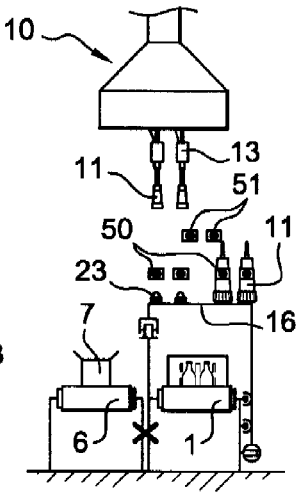
Fig. 19
Fig. 20
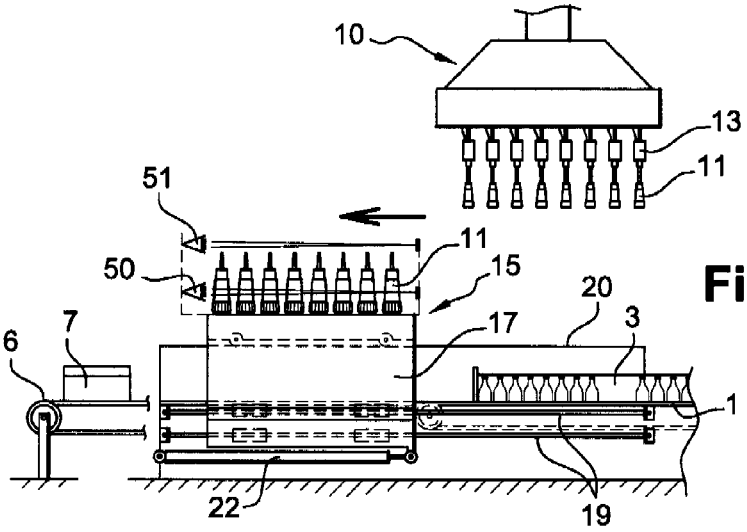

INSTALLATION FOR PACKING BOTTLE-TYPE OBJECTS OF DIFFERENT DESIGNS INTO BOXES

FIELD OF THE INVENTION

The present invention relates to installations for packing bottle- or flask-type or other objects into boxes, and in particular an installation which is suitable for handling and carrying out the packing of bottle-type objects, the designs of which can vary depending on the series of bottles to be placed in boxes.

DESCRIPTION OF THE PRIOR ART

In these installations, the bottles arrive in line, in positioning channels; they are grouped together and are picked up by means of a handling head which puts them down in an appropriate box, or several boxes as appropriate, on a conveyor or other device, arranged on the side of said channels.

Certain installations, which are universal in character, are suitable for handling several designs of bottles. In this case it is necessary to change the gripping tools, which tools, when bottles are involved, are commonly called "tulips". In the remainder of the text, moreover, the terms "bottles" and "tulips" are essentially used in the interests of simplicity.

The gripping tools are designed in order to be suitable for several designs of bottles the dimensions of which are relatively similar. But when the variety of the designs and the magnitude of the dimensions are significant, it is necessary to change all the tools and install others which can pick up another range of bottle designs.

This change is carried out manually, tool by tool. The number of tools can be relatively large, of the order of 36 to 48 or more depending on the capacities of the packing installation.

In order to carry out this operation, the operator has a stock of tools which are placed in a sort of magazine situated close to the installation.

SUMMARY OF THE INVENTION

The present invention proposes an installation which is arranged in order to carry out this type of operation without requiring the constant presence of an operator.

The installation for packing bottle-type objects, according to the invention, comprises a conveyor which delivers said bottles, grouped together on one or more lines, to a pick-up station in order to be collected there and then transferred to the packing station by means of a handling head which comprises appropriate tulip-like gripping tools with pneumatic operation, the number of which matches the quantity of bottles to be handled, which tools are integral with said head by means of couplers which can be deactivated, making it possible to release said tools from the head with a view to changing them in order to adapt said head to the different designs of the bottles to be handled; this installation comprises, moreover, an integral magazine, attached to the latter, which magazine comprises an arrangement which makes it possible to house at least two separate groups of tools which are suited to the designs and to the ranges of dimensions of said bottles, each group of tools being received in the magazine on presentation units suited to the shapes and dimensions of said tools, which presentation units comprise a floating spindle for receiving, fixing and centring each tool, which spindle is integral with the structure of the magazine by means of a kind of suspension which offers it the possibility of relatively significant controlled displacement, which displacement is sufficient to absorb the gaps which can be present either when said tools are picked up by said head or at the moment when they are deposited in the magazine.

This arrangement of the installation, with integration of the magazine, makes it possible to change groups of tools in a single operation which can be automated; this change is carried out globally, i.e. the whole group of tools is displaced simultaneously and rapidly.

The success of this operation depends on the fact that each presentation unit is reactive, i.e. it is relatively free, floating, and it cooperates with the handling head, by means of the gripping tool for which it is responsible, both during the operation of depositing the group of tools and during the pick up operation by said handling head.

According to the invention, the coupler which is arranged between the handling head and each gripping tool is of the type comprising a positioning lock, which positioning lock is, on the one hand, subjected to a spring-type elastic element for locking said tool onto said head and, on the other hand, subjected to remote control means for unlocking said tool.

Still according to the invention, the presentation unit is constituted by a centring device in the form of a spindle the diameter of which corresponds to that of the internal cavity of the gripping tool, which spindle is reactive and comprises, at its lower part, a flange which acts as a stop and constitutes the reference plane for depositing said tool.

According to another arrangement of the invention, the spindle of the presentation unit is presented in the form of a skirt and this skirt cooperates with a base which is integral with the structure of the magazine, which skirt is free in relation to its base and permanently pressed against said base by appropriate means which tend to hold it in its normal position for picking up and storing the gripping tools.

Still according to the invention, the base of the skirt of the presentation unit comprises a vertical shaft which is integral with the structure of the magazine, which shaft comprises two guides which act as centring elements and seats for said skirt: —a guide arranged at its upper part and—a guide of the same type arranged at its lower part, which guides are in the form of truncated cones oriented in the same way, with their pointed tip downwards, and they cooperate with bearings, surfaces, of corresponding shape arranged at the upper and lower ends of said skirt.

According to another arrangement of the invention, the means used for pressing the skirt of the presentation unit against the two guides acting as seats are constituted by a helicoidal spring-type elastic element threaded onto the vertical shaft connecting said guides; which spring is inserted between the lower guide and a support surface arranged in said skirt, under the upper conical bearing of the latter.

According to a preferred embodiment of the invention, the magazine is constituted by a mobile structure, mounted on tracks which are tied laterally onto the general chassis of the installation, which magazine is mobile by means of an actuator-type operating device, arranged between said chassis and said structure of the magazine, causing the latter to pass from its inactive position, out of the field of action of the bottle-handling head, to its active position which is situated in said field of action of said head and in particular at the station where the bottles are picked up by said handling head.

Other arrangements and developments are possible without the scope of the invention being exceeded depending, on the one hand, on the architecture of the packing installation and, on the other hand, on the possible movements of the handling head, i.e. depending on the number of axes of movement which it possesses.

According to another arrangement of the invention, the magazine comprises several zones for receiving the groups of tools: —a free zone for receiving and holding the group of tools in place on the handling head and—at least one zone for receiving and storing the group or groups of tools which can be used as a variant, and it comprises means for checking the presence, or absence, of the different groups of tools, which checking means are arranged in order to check the presence, or the absence, of said tools, both in the magazine and on the handling head.

The invention also relates to the method for changing gripping tools for a packing installation as described previously; this method involves, for picking up said tools in the magazine: —releasing the positioning lock of the coupler which is situated between the handling head and each gripping tool in order to reduce the effort of coupling said tools with said couplers and,—lightly pressing said handling head onto said tools in order to cause a reaction by the latter and in particular their respective presentation units which, under the effect of their suspension, automatically and elastically position said tools in their respective couplers.

According to another arrangement of the invention, the method involves, during the depositing of the group of gripping tools in the magazine, simultaneously applying, to each tool, the pneumatic pressure for the actuation of said tools, in order to encourage, at each coupler, the ejection of said tools.

BRIEF DESCRIPTION OF THE DRAWINGS

But the invention is also described in detail by means of the following description and attached drawings, given by way of illustration and in which:

FIGS. 16 and 17 show the handling head during the deposit of another group of gripping tools;

FIGS. 18 and 19 show the handling head after the deposit of the other group of gripping tools; and FIG. 20 shows the return of the magazine in the inactive position shown in FIG. 2.

DETAILED DESCRIPTION OF THE INVENTION

Figure 1:
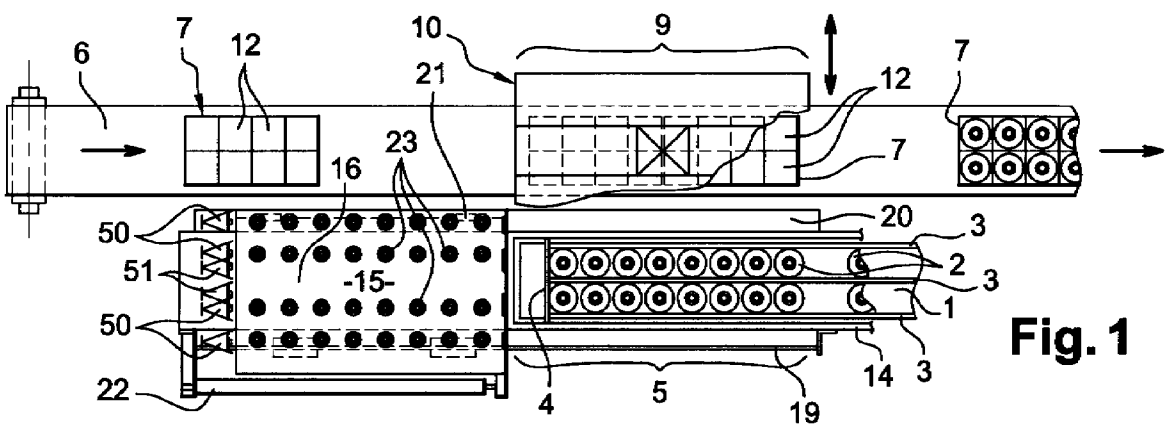
FIG. 1 is a diagrammatic top view of the packing installation according to the invention.

The installation represented in FIG. 1 comprises a conveyor (1) for delivering the bottles (2) to be packed, which bottles are separated by channels (3) and they are grouped together, at the end of the conveyor (1), by means of a stop (4) which, in a certain manner, delimits the station (5) where the bottles are picked up.

On the side of this conveyor (1) for delivering the bottles, the conveyor (6) for delivering the empty boxes (7) is to be found; these boxes (7) are intended for receiving the bottles at the packing station (9) which is situated on the side and facing the pick-up station (5).

The transfer of the bottles between the pick-up station (5) and the packing station (9) is carried out by means of a handling head (10) which is arranged in order to take a batch of bottles and move this batch from one station to the other.

Figure 3:
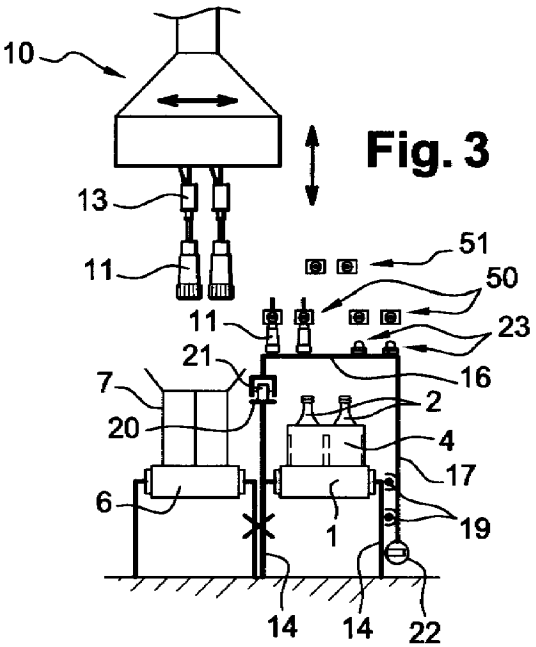
FIG. 3 is a view of FIG. 2 from the left.
Figure 2:
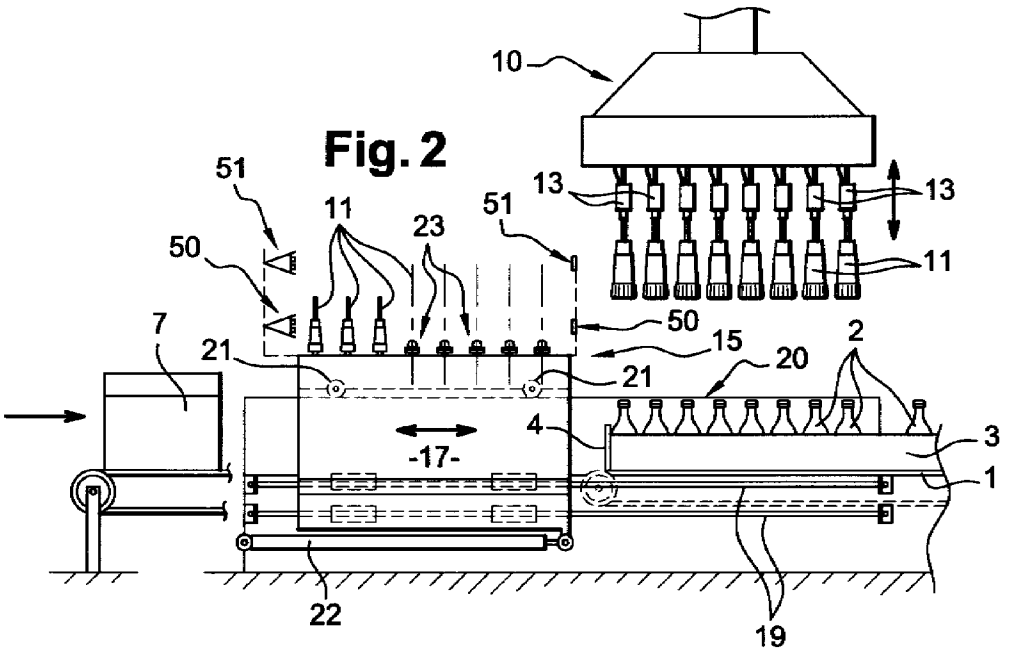
FIG. 2 is a side view of the installation, with the magazine in the inactive position.

As can be seen in FIGS. 2 and 3, the bottle-handling head (10) comprises gripping tools (11) the number of which matches the number of compartments (12) of the box or boxes (7) which are intended to receive the bottles. These tools (11) are commonly called "tulips" due to their shape which resembles an upturned chalice. In the remainder of the text, the terms "tulips" or "tools" with the same reference (11) are used indiscriminately.

These tools (11) are integral with the head (10) and each fixed by means of a coupler (13) which makes it possible to assemble them and remove them easily in order to change the model depending on the design of the bottles and in particular the shape and diameter of the necks of these bottles. This coupler (13) is described in detail below in connection with FIGS. 4, 8 and 9.

The conveyor (1) for delivering the bottles is arranged on the chassis (14) of the installation and this chassis supports, arranged at the end of said delivery conveyor (1), a magazine (15) arranged for storing and receiving groups of gripping tools (11). This magazine (15) is positioned, preferably, close to the bottle-handling head (10).

In the embodiment shown in FIGS. 1 to 3, the magazine (15) is mobile between an inactive position where it is situated outside the operating area of the handling head (10) and a position where it is situated at the pick-up station (5) in order to allow the operation of changing the group of gripping tools (11).

This constructive arrangement corresponds to a particular embodiment which makes it possible to integrate the magazine (15) in a packing installation without complicating the movements of the bottle-handling head (10).

Depending on the displacement capacities of the handling head (10) which can be associated with a multi-axis robot, with 6 axes for example, and depending on the architectural possibilities of the installation, the magazine (15) can be fixed or be positioned in all the zones accessible to said handling head (10), either on the side of the packing station (9), or between the latter and the pick-up station (5).

In the embodiment shown in FIGS. 1 to 3, the magazine (15) is presented in the form of a bridge and its upper part is presented in the form of a tray (16), which tray (16) can be positioned at the pick-up station (5), above the bottle channels (3) and optionally above the latter.

The tray (16) of the magazine (15) is supported, on one side, by a lateral structure in the form of a wall (17), the lower part of which is guided on the general chassis (14) of the installation by means of a pair of tracks (19). On the other side, the tray (16) is supported by a rail (20) which is also integral with the chassis (14), which tray comprises rollers (21) which roll on said rail (20) so as to impart great precision to the guiding and positioning of this magazine (15) in relation to the handling head (10).

This rail (20) can be situated high up, as shown in FIGS. 2 and 3, at a level which is close, for example, to that of the necks of the bottles (2), or lower down, simply above the level of the channels (3) of the pick-up station (5).

The tracks (19), like the rail (20), are horizontal, parallel to the plane of the conveyor (1) which delivers the bottles to the pick-up station (5).

The magazine (15) is manipulated, so as to pass from its inactive position to its active position for receiving or delivering the gripping tools (11), by means of an actuator-like operating device (22) which is inserted, for example, between the side wall (17) of the magazine (15) and the chassis (14).

In the example shown in the figures, the tray (16) is arranged for receiving two different groups of gripping tools (11); each group of tools (11) being suited to one design of bottles or to several designs of bottles as appropriate. Each group of gripping tools (11) comprises, for example, two rows of tools (11) arranged in parallel.

In order not to overload FIG. 1, each group of gripping tools (11) has been limited to two rows and the number of gripping tools per rows is eight, by way of example.

This arrangement of the tray (16) of the magazine (15), for receiving the tools (11), consists of a multitude of presentation units (23) which are independent of each other and integral with said tray (16).

Figure 4:
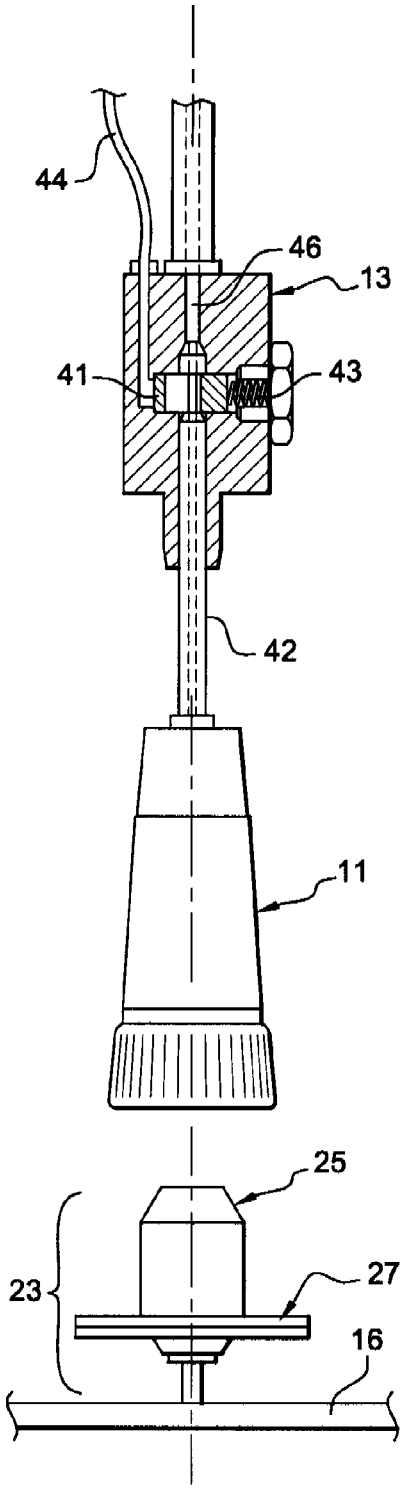
FIG. 4 shows, on the one hand, a presentation unit which is waiting for a tool and, on the other hand, the assembly of said tool with its coupler.

A presentation unit (23) is shown in FIG. 4, installed on the tray (16) of the magazine (15). This presentation unit (23) is positioned under a gripping tool (11) which is assembled with the coupler (13) which is described in detail below.

Figure 7:
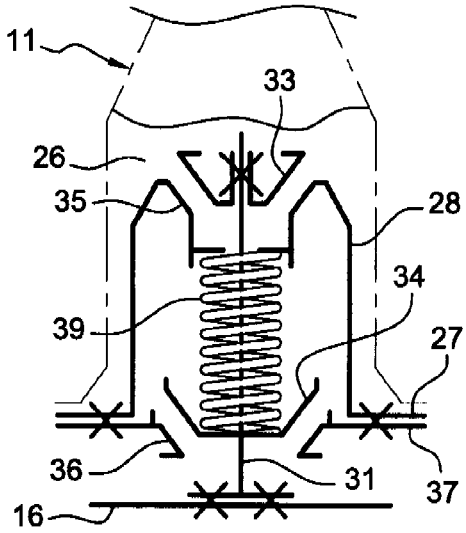
FIG. 7 shows the reaction capacity of the presentation unit depending on the pressures on the gripping tool when the latter, which is represented by fine chain-dotted lines, is deposited or taken up by the handling head.
Figure 8:
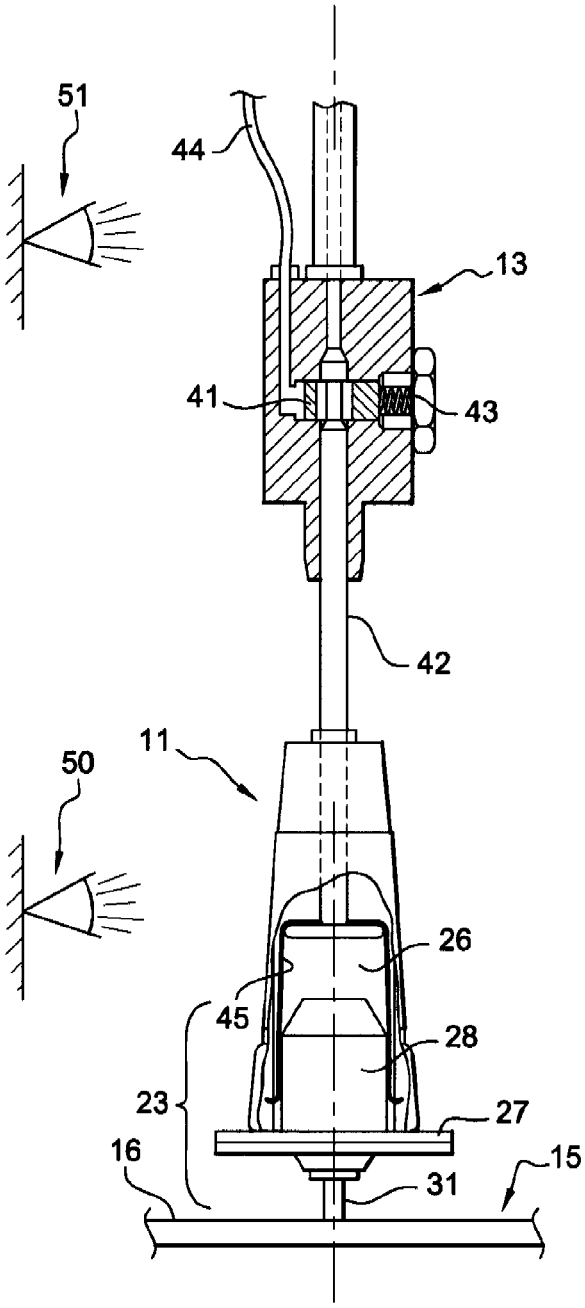
FIG. 8 shows the introduction of the tail of the gripping tool in its housing situated on the coupler.

The presentation unit (23) comprises a centring device in the form of a spindle (25) the external dimensions of which correspond to that of the internal cavity (26) of the gripping tool (11), which internal cavity (26) can be seen in FIGS. 7 and 8 in particular. This spindle (25) comprises, at its lower part, a flange (27) which acts as a stop for the lower flange of the tool (11) and also constitutes the reference plane for depositing said tool (11).

Figure 5:
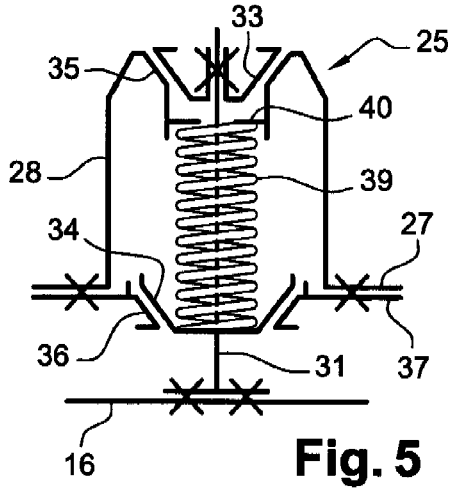
FIG. 5 shows, diagrammatically, a presentation unit in vertical section.

The spindle (25) of the presentation unit (23) is presented, as shown in greater detail in FIG. 5, in the form of a skirt (28); this skirt (28) is constituted by a vertical cylindrical tubular body with, at its upper part, an input cone and, at its lower part, the flange (27) which acts as a stop.

Figure 6:
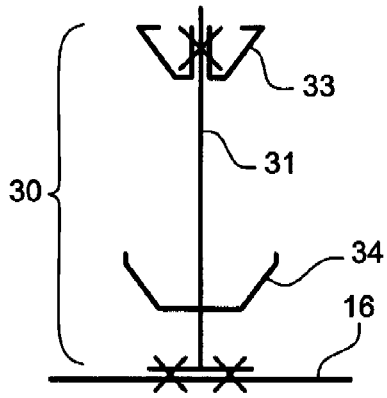
FIG. 6 shows just the base of the presentation unit, which base is integral with the magazine tray.

The skirt (28) is mounted on a specific structure which is shown by itself in FIG. 6. This structure forms a base (30) which is integral with the tray (16) of the magazine (15) and it acts as a seat for the skirt (28). This base (30) is constituted by a shaft (31) which is integral with the tray (16) of the magazine (15) and it extends vertically, perpendicular to said tray (16).

This shaft (31) comprises, as shown in FIG. 6, two guides which are responsible for centring the skirt (28) and form the seat of the latter: —a guide (33) arranged at the upper part and—a guide (34) of the same type arranged at the lower part; these two guides (33, 34) correspond to truncated cones which are oriented in the same way with their tip downwards, i.e. towards the tray (16).

The upper guide (33) of the base (30) cooperates with a bearing (35) of corresponding shape arranged at the upper part of the skirt (28).

The lower seat (34) of the base (30) cooperates with a bearing (36) which is arranged on a washer (37); this washer (37) closes the lower part of the skirt (28) and is integral with the flange (27) of said skirt (28).

The skirt (28) is permanently pressed against the two guides (33, 34) by appropriate means described in detail hereafter which tend to hold it in its normal position for picking up and storing the gripping tools (11).

The means used for permanently pressing the skirt (28) against the two guides (33, 34) are constituted by a helicoidal spring-type elastic element (39) which is centred on the shaft (31) of the base (30); this spring (39) is inserted between the lower seat (34) and a shoulder (40) arranged in the upper part of the skirt (28), under the upper conical bearing (35) of the latter.

Thus, as illustrated in FIG. 7, the skirt (28) has a certain degree of freedom in relation to its two guides (33, 34); it is mounted floating and it can, as a result, react elastically to the pressures of the handling head, not shown, by means of the gripping tool (11) which it receives, which tool (11) is represented partially in fine chain-dotted lines.

During the depositing of the gripping tools (11) in the magazine (15), all the spindles (25) can absorb the positioning gaps and adapt flexibly to the position of the different tools (11) which they receive, which allows each tool (11) to slide gently over the skirt (28) from its receiving spindle (25), up to the flange (27) of the latter.

FIG. 4 also shows the gripping tool (11) assembled with the coupler (13) by means of a positioning lock (41). The coupler (13) comprises a positioning lock (41) in the form of a bolt which cooperates with the upper end, or end piece, of the rod (42) of the gripping tool (11); this positioning lock (41) is, for example, permanently pressed by a spring-like elastic element (43) for holding said rod (42) and it is arranged in order to form, with the body of said coupler (13), a kind of actuator the operation of which is carried out by means of an appropriate fluid delivered by the line (44) in order to be able to release said rod (42) by unlocking it.

A coupler of this type is in particular described in the document EP 274 332.

FIG. 8 shows the gripping tool (11) installed on its presentation unit (23) and also shows the positioning lock (41) in the inactive locking position of the rod (42) of this tool (11). This position of the coupler (13) in relation to the tool (11) is observed during the pick-up operation of said tool (11) by said coupler (13) or, as appropriate, during the release operation of said tool (11) by said coupler (13).

In order to facilitate this release, the rod (42) can be ejected using the fluid under pressure which serves to inflate the membrane (45) of the tool (11). The application of this fluid, compressed air, is carried out via the line (46) of each tool (11) and causes the inflation of their membrane (45), which membrane (45) is tightened onto the skirt (48) of the presentation unit (23), which has the effect of immobilizing each tool (11) on its presentation unit (23) and this compressed air can, simultaneously, exert a pressure on the end of the rod (42) of said tool (11), facilitating its ejection from the coupler (13).

Figure 9:
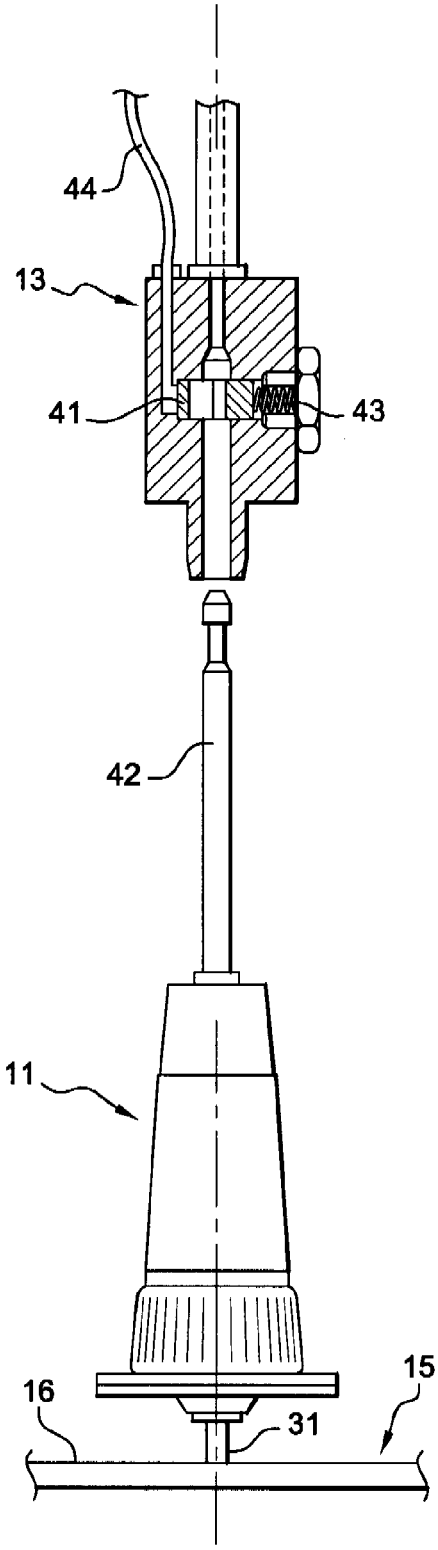
FIG. 9 shows the tool on its presentation unit, in the magazine, after being deposited by the coupler.

FIG. 9 shows a gripping tool (11) which is released from the coupler (13), which tool (11) is in the storage position in the magazine (15).

FIG. 8 also shows the presence of sensors (50, 51) which check the presence or the absence of the tools (11), both in the magazine (15) and on the gripping head (10) and in particular under the couplers (13).

These sensors (50, 51) can be constituted by photoelectric cells or a robotic vision system which checks the presence and/or the absence of the tulips.

In the embodiment shown, sensors (50) monitor the presence or the absence of the tools (11) in the magazine and sensors (51) monitor the presence, or the absence, of the tools (11) under the couplers (13).

These sensors (50, 51) each monitor a line of tools (11) or of couplers (13). There are as many sensors (50) as there are lines, or rows, of tools (11) in the magazine (15); the same is true for the sensors (51), the number of which corresponds to the number of lines of couplers (13).

FIGS. 10 to 21 illustrate a complete operation of changing gripping tools (11) with FIG. 2 as the starting point.

In this FIG. 2, the magazine (15) is in the inactive position, loaded with a group of tools (11) which correspond to small tulips. The handling head (10) operates with a group of tools (11) the tulips of which are suitable for large bottles (2).

When the packing of the large bottles is completed and the new bottles to be packed are much smaller, the group of gripping tools (11) should be changed in order to use more suitable tulips.

Figure 10:
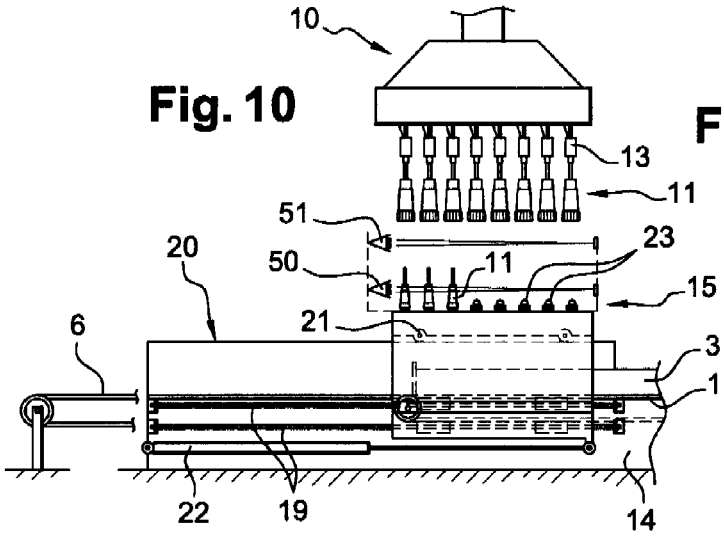
FIG. 10 is a side view of the installation with the magazine in the active position.
Figure 11:
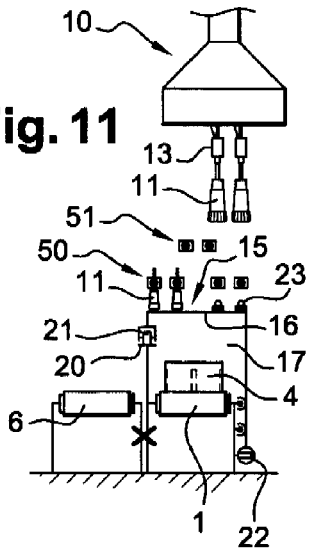
FIG. 11 is a view of FIG. 10 from the left.

In an initial phase, the handling head (10) being in the high position, the magazine (15) is displaced by means of its actuator (22); it is taken to the bottle pick-up station (5), with its stock of tools (11), as shown in FIG. 10. FIG. 11 shows that the handling head (10) is positioned above the presentation units (23) which are free in order to deposit the tools (11) to be stored there.

Figure 12:
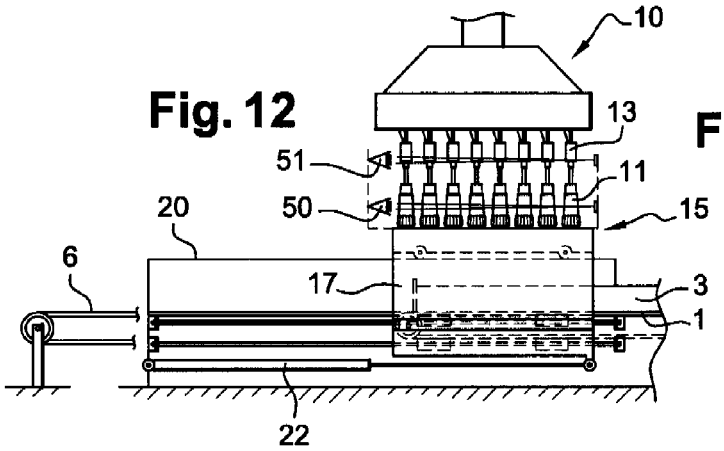
FIGS. 12 and 13 show the handling head during the deposit of all the gripping tools.
Figure 13:
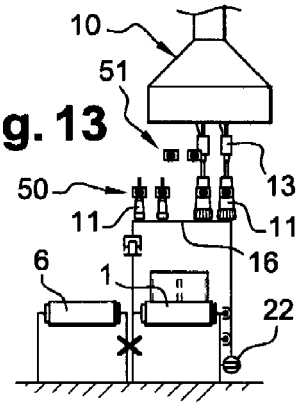

Then, as shown in FIGS. 12 and 13, the handling head (10) moves down and all of the gripping tools (11) are flexibly threaded onto the spindles (25) of the presentation units (23), as shown in FIGS. 4 and 8.

In order to release the gripping tools (11), the positioning locks (41) are actuated simultaneously, as described in detail above in connection with FIG. 8 and, in order to encourage the ejection of said tools (11), the pressure is established in said tools which has the effect of tightening each tool (11) on the skirt (28) of the corresponding presentation unit (23) and, simultaneously, of exerting a pressure on the rod (42) of each tool (11).

Figure 14:
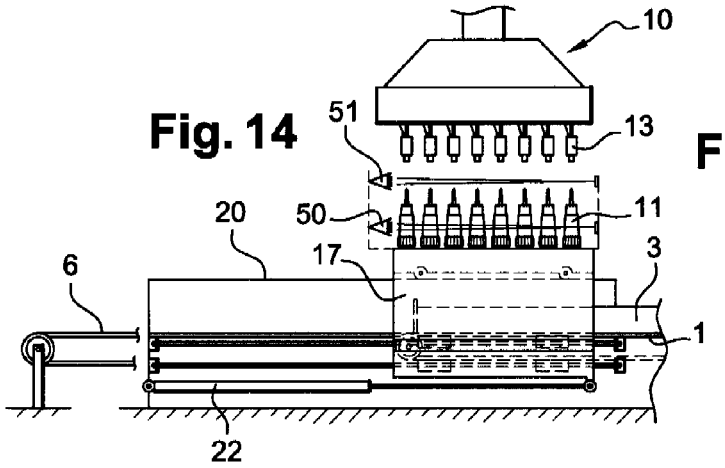
FIGS. 14 and 15 show the handling head after the deposit of a group of gripping tools.
Figure 15:
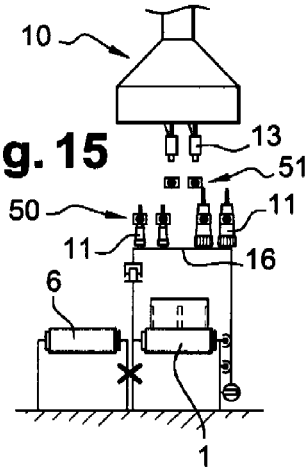

The head (10) can then move back up, as shown in FIG. 14, and it shifts sideways, as shown in FIG. 15. In an initial phase, this shift makes it possible to verify, by means of the sensors (51), that all the couplers (13) are indeed free. These sensors (51) are, for example, distributed on either side of the median vertical plane of the tray (16).

After this verification, the shifting can take place in order to place the couplers (13) above the presentation units (23) and the head (10) can move down, as shown in FIGS. 16 and 17, in order to pick up the other group of tools (11) the tulips of which are better suited to the new design of bottles.

It is observed that the head (10) adapts automatically to the distance of the presentation units (23) from the tray (16) of the magazine (15). In fact, these presentation units (23) are distributed regularly over the tray (16) at the same distance which makes it possible to have a relatively universal magazine (15) capable of receiving different kinds of groups of gripping tools. The tray (16) is shown with two groups corresponding to two models of tools (11) in the different figures, but it can comprise three groups and more depending on the versatility of the installation.

When the handling head (10) is equipped with the new gripping tools (11), it can move back up as shown in FIGS. 18 and 19 and, at the same time, the sensors (50) check that all the tools have indeed left their presentation unit (23). The new, small, bottles (2) to be packed can then arrive at the pick-up station.

As shown in FIG. 20, the magazine (15) is retracted out of the pick-up station (5), in order to free the passage and the handling head (10) can resume its packing rates for the new design of bottles.

Complementary arrangements can be provided for bottles (2) of a particular shape which need, for example, to be held in an unchanged position between being picked up by the gripping head (11) and being deposited in a box by this same head. This is the case in particular with square-shaped bottles for which it is necessary to keep the same position between that which they occupy on the delivery conveyor (1) and that which they will have in the packaging box (7).

The coupler can comprise, for example, a pin, not shown, which cooperates with a slot of complementary shape arranged on the rod (42) of each tool (11).

This indexing of the tools (11) in relation to their coupler may be necessary for bottles of square section and also for flasks or other objects.

What is claimed is:

1. Installation for packing bottles or other objects like flasks, comprising a chassis which supports a conveyor which delivers said bottles, grouped together on one or more lines to a pick-up station, a picking station where there is a pick-up operation, a packing station where there is a deposing operation, a handling head to transfer collected bottles to the packing station, which handling head comprises appropriate tulip-shaped gripping tools with pneumatic operation, which gripping tools are integral with said handling head by means of couplers which can be deactivated allowing them to be changed in order to adapt said handling head to the shape and the diameter of the neck of these bottles, wherein the installation further comprises a magazine making it possible to house at least two separate groups of gripping tools, which magazine comprises presentation units suited to the shapes and dimensions of said gripping tools, which presentation units are constituted by a spindle, of floating type, for receiving, fixing and centering said gripping tools, which spindle is integral with a tray of the magazine by means of a suspension permitting relative controlled displacement, in order to provide a flexibility and to cooperate with said gripping tools both during the depositing operation and during the pick-up operation of the gripping tools.

2. Installation according to claim 1, wherein the coupler arranged between the handling head and each gripping tool comprises a positioning lock in the form of an actuator which cooperate with the rod of the gripping tool, which positioning lock, or actuator, is subjected to a spring-type elastic element for the locking in position of said gripping tool on said handling head and to a fluid delivered by a line in order to release the rod of said gripping tool.

3. Installation according to claim 1, wherein each presentation unit is constituted by a centring device in the form of a spindle the diameter of which corresponds to that of the internal cavity of the corresponding gripping tool, which spindle comprises, at its lower part, a flange which acts as a stop and constitutes the reference plane for the depositing of said gripping tool.

4. Installation according to claim 3, wherein the spindle of the presentation unit is presented in the form of a skirt and this skirt cooperates with a base which is integral with the tray of the magazine, which skirt has a degree of freedom in relation to its base and is permanently pressed against said base by appropriate means which tend to hold it in its normal position for picking up and storing the gripping tools.

5. Installation according to claim 4, wherein the base of the skirt comprises a vertical shaft which is integral with the tray of the magazine, which shaft comprises two guides for centring said skirt: —a guide arranged at its upper part and—a guide of the same type arranged at its lower part, which guides are in the form of truncated cones oriented in the same way with the tip downwards and they cooperate with bearings of corresponding shape, arranged respectively at the upper and lower ends of said skirt.

6. Installation according to claim 5, wherein the means used for permanently pressing the skirt against the two seats are constituted by a spring-like elastic element which is inserted between the lower guide and a shoulder arranged in said skirt, under the upper conical bearing of the latter.

7. Installation according to claim 1, wherein the magazine is constituted by a mobile structure mounted, in particular, on tracks which are attached laterally onto the chassis of said packing installation, which magazine is mobile by means of an actuator-type operating device, integrated between said magazine and said chassis, in order to cause said magazine to pass from its inactive position, out of the field of action of the bottle-handling head, to its active position in said field of action of said handling head and in particular at the pick-up station where the bottles are picked up by said handling head.

8. Installation according to claim 7, wherein the magazine comprises several zones for receiving the groups of gripping tools: —a free zone for receiving and holding the group of tools in place on the handling head and—at least one zone for receiving and storing the group or groups of gripping tools which can be used as a variant, and it comprises sensors which are arranged in order to check the presence, or the absence, of the different groups of said gripping tools, both in the magazine and on the handling head.

9. The installation according to claim 1, wherein the bottles are flasks.

10. An installation for packing containers, comprising:

a chassis that supports a conveyor that delivers the containers, grouped together on one or more lines to a pick-up station;

a picking station where a pick-up operation occurs;

a packing station where a deposing operation occurs;

a handling head that transfers collected containers to the packing station, the handling head comprises pneumatic tulip-shaped gripping tools, the gripping tools are releasably coupled to the handling head by a coupler that is configured to be selectively deactivated;

a magazine housing at least two separate groups of gripping tools, the magazine comprises mounts shaped and dimensioned to support said gripping tools, each of the mounts comprising a floating spindle that receives, fixes and centers a corresponding one of the gripping tools; the spindle is integral with the magazine and supported for relative displacement with respect to the handling head to carry out a change of the gripping tools coupled to the handling head by deposition of the gripping tools coupled to the handling head into the magazine and by coupling to the handling head to new gripping tools picked up from the magazine.

11. The installation according to claim 10, wherein the containers are bottles.

* * * * *